United States Patent [19]

Geiger

[11] Patent Number: 4,779,749

[45] Date of Patent: Oct. 25, 1988

[54] CLOSURE DEVICE OF THE SNAP-ENGAGEMENT AND UNSCREW TYPE

[76] Inventor: Reinold Geiger, 3 Rue Salomon Reinach, 78100 St. Germain en Laye, France

[21] Appl. No.: 99,465

[22] Filed: Sep. 21, 1987

[30] Foreign Application Priority Data

Sep. 22, 1986 [FR] France ..... 86 13224

[51] Int. Cl.[4] ..... B65D 41/22

[52] U.S. Cl. ..... 215/295; 215/318

[58] Field of Search ..... 215/318, 295

[56] References Cited

U.S. PATENT DOCUMENTS 3,430,798 3/1969 Goyet et al. ..... 215/295

3,468,447 9/1969 Smalley ..... 215/295

*Primary Examiner*—Donald F. Norton

*Attorney, Agent, or Firm*—Mason, Fenwick & Lawrence

[57] ABSTRACT

A closure device for the neck (1) of a container (2), using a plug (3) having some degree of elasticity, of the type in which closure is obtained by axial snap-engagement, opening being obtained by rotation or unscrewing, the neck (1) and the plug (3) having, on the one hand, a first continuous projection (4) and at least a second localized projection (5), which are adapted to co-operate with one another by axial snap-engagement in order to close the closure device and, on the other hand, a ramp (6) having at least one V-shaped or pseudo-V-shaped profile and at least a third localized projection (7) adapted to co-operate with one another by relative sliding in order to open the closure device by rotation or unscrewing, the first and third projections (4, 7) on the one hand being disposed on the neck (1) and the second projection (5) and the ramp (7) on the other hand being disposed on the plug (3).

12 Claims, 2 Drawing Sheets

D

CLOSURE DEVICE OF THE SNAP-ENGAGEMENT AND UNSCREW TYPE

This invention relates to a closure device of the snap-engagement and unscrew type. A device is already known for closing a container neck by means of a plug having a degree of elasticity, of the type in which closure is obtained by axial snap-engagement and opening is effected by rotation or unscrewing. In a known closure device of this kind, the neck has, on the one hand, a first continuous projection and, on the other hand, a ramp comprising a number of successive V-profiles. The plug has on the one hand a second and a third localized projection. The first and second projections can co-operate with one another by axial snap-engagement to close the closure device. The third projection and the ramp can also co-operate with one another by relative sliding in order to open the closure device by rotation or unscrewing.

In the known closure device, the neck, the container adjacent the neck, and the plug have a non-circular contour in transverse crosssection, more particularly a curved pseudo-rectangular section with the concavity facing the inside and radiused corners so as to suggest to the user that the plug and the neck are associated with certain relative radial positions for closure, i.e. a closure position in which the third projection and the ramp do not co-operate with one another or, at least, do not prevent the first and second locking projections from co-operating with one another and hence providing closure.

On unscrewing, rotation about the axis of the container and the plug brings the plug and the neck from a relative closed position to a relative open position in which the third projection and the ramp cooperate to create an axial mutual disengagement force sufficient to disengage the first and second projections.

In the known closure device, the second and third projections borne on the inner side surface of the plug are closely associated with one another and together form a projection of complex shape. The first projection is formed in relief on the outer side surface of the neck.

The ramp is formed on the neck, at its base, more particularly at the junction with the container. It has high spots situated in the corners and low spots situated in the central part of the sides (the corners and the sides being defined with respect to the transverse cross-section of the neck).

The known closure device has a number of disadvantages.

The ramp is situated at the base of the neck and is therefore particularly visible once the plug has been removed from the neck; the plug and the neck necessarily have an irregular shape and this is not very suitable for a number of applications; the elasticity of the plug is limited because of the construction used and the side surface of the plug is deformed on unscrewing, this deformation being visible from outside.

The object of the invention is to provide a closure device of the type which is closed by axial snap-engagement and opened by rotation or unscrewing, comprising a first, a second, and a third projection, and a ramp, so that the ramp is relatively invisible from the outside, particularly when the container is open.

Another object of the invention is to provide a closure device of this type which may have a circular contour in transverse crosssection.

Another object of the invention is to provide adequate plug elasticity and avoid any visible deformation of the side surface of the plug on unscrewing.

To this end, the invention proposes a closure device for the neck of a container, using a plug having some degree of elasticity, of the type in which closure is obtained by axial snap-engagement, opening being obtained by rotation or unscrewing, the neck and the plug having, on the one hand, a first continuous projection and at least a second localized projection, which are adapted to co-operate with one another by axial snap-engagement in order to close the closure device and, on the other hand, a ramp having at least one V-shaped or pseudo-V-shaped profile and at least a third localized projection adapted to co-operate with one another by relative sliding in order to open the closure device by rotation or unscrewing, characterised in that, on the one hand, the first and third projections are disposed on the neck and, on the other hand, the second projection and the ramp are disposed on the plug.

The third projection is of a very limited radial size, e.g. a few degrees. Also, it preferably does not project appreciably. Consequently it is extremely hidden from the exterior. Since the ramp is disposed on the plug adjacent its transverse apex, i.e. at a distance from the remote free edge of the plug, it is practically invisible from the exterior. Also it is completely invisible when only the container is looked at, since it is situated on the plug.

The presence of a ramp comprising the profiled free edge of an inner skirt combined with an outer split skirt on which the second projection is provided, and a masking ring and, if required, a sealing and/or axial guide means, makes the operation of the closure device efficient and enables the plug and neck to be made with a circular cross-section.

Other characteristics and advantages of the invention will be apparent from the following description with reference to the accompanying drawings wherein.

Figures 1, 2, 4:
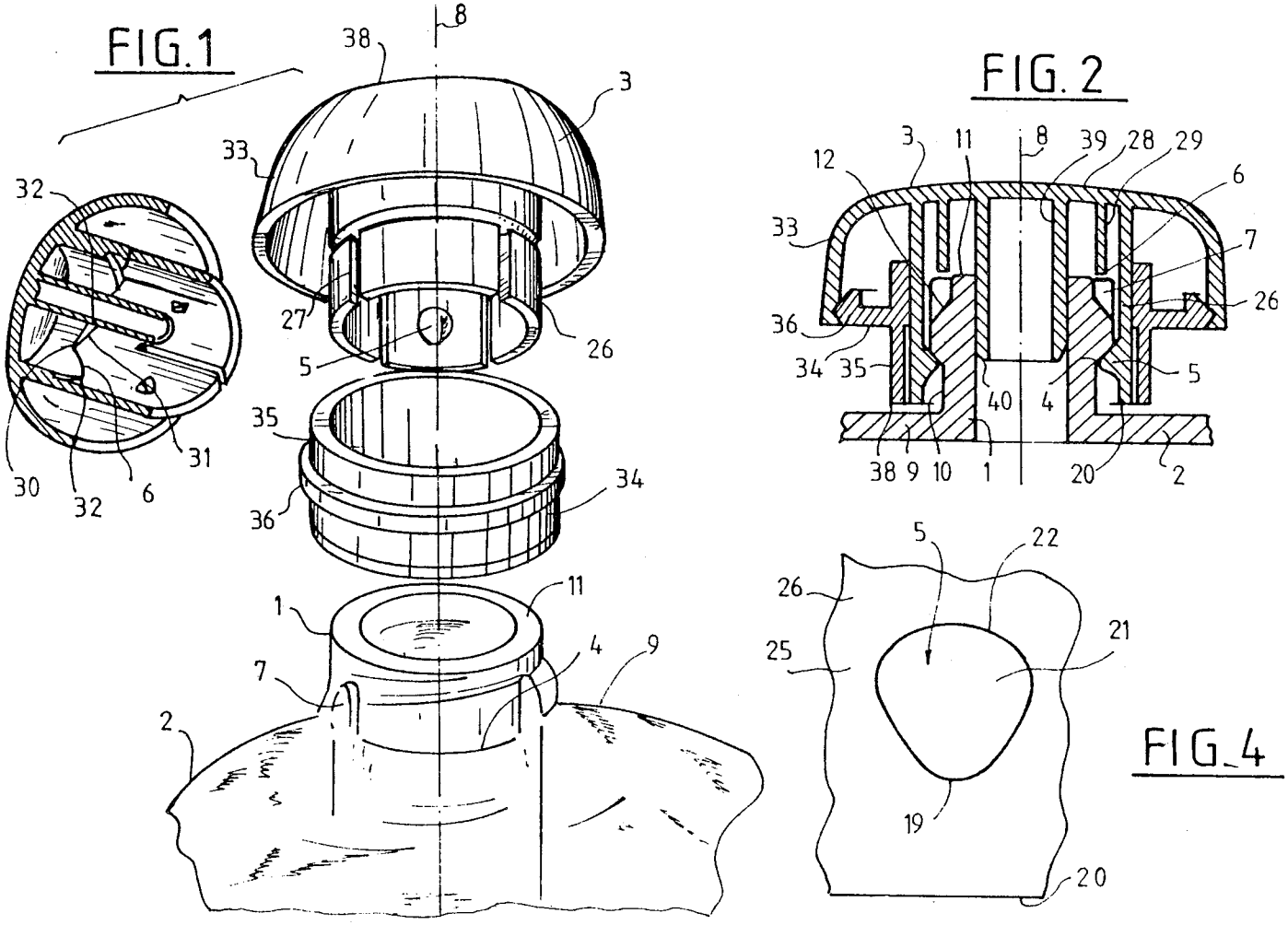
FIG. 1 is a diagrammatic exploded perspective view of the closure device according to the invention in one possible embodiment.
FIG. 2 is a diagrammatic axial section of the closure device of FIG. 1 in the closed position.
FIGS. 4 and 5 are two diagrams in elevation and to a larger scale of the second and third projections of the device respectively.

The invention relates to a closure device for the neck 1 of a container 2, using a plug 3 having some degree of elasticity, of the type in which closure is obtained by axial snap-engagement, opening being obtained by rotation or unscrewing, the neck and the plug having, on the one hand, a first continuous projection 4 and at least a second localized projection 5, which are adapted to co-operate with one another by axial snap-engagement in order to close the closure device and, on the other hand, a ramp 6 having at least one V-shaped or pseudo-V-shaped profile and at least a third localized projection 7 adapted to co-operate with one another by relative sliding in order to open the closure device by rotation or unscrewing.

According to the invention, the closure device is characterised in that, on the one hand, the first and third projections 4, 7 are disposed on the neck 1 and, on the other hand, the second projection 5 and the ramp 6 are disposed on the plug 3.

Figures 3, 5:
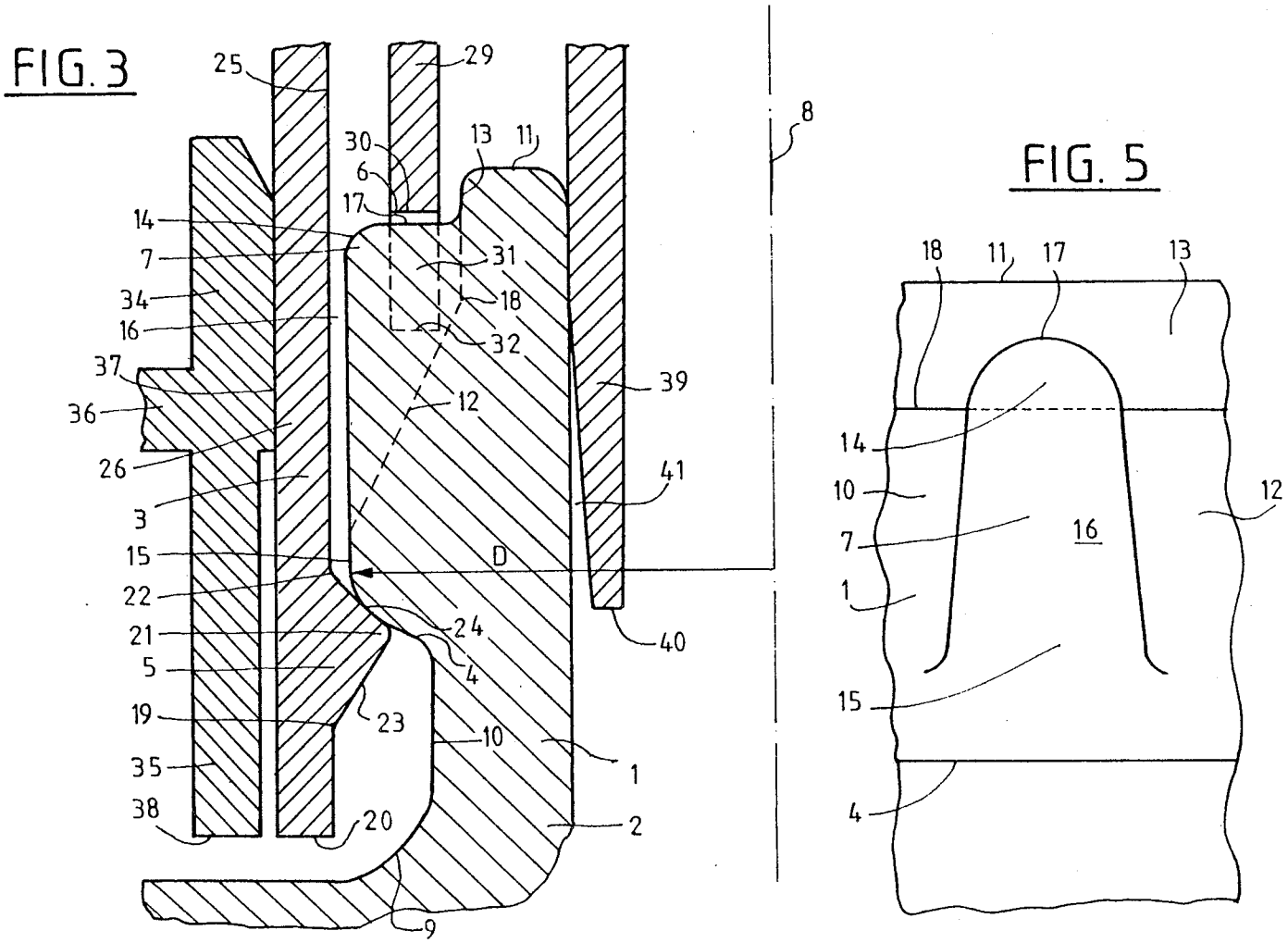
FIG. 3 is a detail to a larger scale than FIG. 2.

The closure device, as shown in FIG. 3, comprises an axis 8 of symmetry, which is normally disposed vertically, the container 2 extending downwardly with the neck 1 extending upwardly; the plug 3 caps the neck 1 in the closed position.

According to one possible feature, the neck 1 and/or the plug 3 have a circular contour in transverse cross-section.

The neck 1 is generally completely or partly of a smaller external radial size than the container 2 near the neck 1, the latter being connected to the container 2 by a shoulder 9 if required.

The first projection 4 is, on the one hand, situated on the outer side surface 10 of the neck 1 near the shoulder 9, i.e. remote from the free edge 11 of the neck 1. On the other hand the first projection 4 is directed towards the shoulder 9, i.e. remote from the free edge 11. It is circumferential, and is preferably continuous around the axis 8.

In a preferred embodiment, the first projection 4 is slightly curved with a concavity facing the axis 8. It is connected to the side surface 10, on the one hand, adjacent the shoulder 9, perpendicularly or substantially perpendicularly and, on the other hand, adjacent the free edge 11, by means of a radiused portion in the form of surface 12 inclined, for example, 30° to the axis 8. The inclined surface 12 meets the side surface 10 near the free edge 11, and defines a short axial portion 13 of the side surface 10 adjoining the free edge 11.

The third projection 7 is situated on the outer side surface 10 of the neck 1 between the first snap-engagement projection 4 and the free edge 11 of the neck 1.

In elevation, the third projection 7 has a general inverted-V shape with a radiused bend forming an apex 14 so that, on the one hand, the base 15 of the third projection 7 substantially adjoins the first snap-engagement projection 4 and is of thin or zero thickness and, on the other hand, the apex 14 is of a greater thickness than the base 15.

The outer side surface 16 of the third projection 7 extends parallel to the axis 8 of the device.

The apex 14 of the third projection 7 is slightly offset with respect to the free edge 11 of the neck 1 and is defined by a ridge 17 at least substantially at right angles to the axis 8 of the device.

As will be apparent particularly from FIG. 5, to which reference is now made, the third projection 7 extends axially along the axis 8, the inverted V that it forms being open only a little.

Reference is now made to FIG. 3, in which the third projection 7 is shown in section and has a general shape of an inverted pseudo V with a large web (outer side surface 16 and small sides (ridge 17 on the one hand and first projection 4 on the other hand). The apex 14 is situated in the immediate vicinity of the free edge 11, closer to the latter than is the line 18 at the juncture of the inclined surface 12 and the outer side surface 10.

The container 2 may be made of glass or plastic. It may be intended for any required use. More particularly, it may be used for perfume. In the latter case, by way of example, the inside diameter of the neck 1 may be of the order of 8 mm, the outside diameter of the order of 16 mm and the axial height (between shoulder 9 and free edge 11) of the order of 13 mm.

The maximum radial thickness of the first and third projections 4, 7 may be of the order 1.5 mm.

The plug 3 is preferably made of plastic and locally has the elasticity required for operation of the device.

The second projection 5 borne by the plug 3 has, in elevation, a general triangular shape with a radiused tip 19 directed towards the free edge 20 of the plug 3, and near said edge 20, the second projection 5 of thin or zero thickness at the place of said tip 19 and of larger thickness in its central part 21.

Referring now to FIG. 4, in which the second projection 5 is shown in elevation, the side 22 of the second projection 5 remote from the tip 19 is curved with the concavity facing the tip 19 to form a semicircle or a semi-ellipse or a similar shape.

Reference will now be made to FIG. 3, in which the second projection 5 is shown in section and has a general shape of an inverted pseudoV having a central part 21 and forming a radiused apex and two limbs 23, 24 connecting said apex on the one hand to the juncture 19 and on the other hand to the side 22.

The second projection 5 is borne on the inner surface 25 of an outer skirt 26, more particularly near the free edge of the outer skirt 26 thus forming the free edge 20 of the plug 3. The limbs 23, 24 are inclined, for example, by 30° and 45° respectively to the axis 8. The inside diameter of the outer skirt 26 is slightly larger than the outside diameter D of the neck 1 at the site of the first and third projections 4, 7 to allow introduction of the plug 3 on the neck 1. The inside diameter at the central part forming the tip 21 of the second projection 5 is less, more particulary very slightly less (of the order of a millimeter or a few millimeters, for example) than the diameter D.

In the closed position, the second projection 5 co-operates with the first projection 4, the limb 24 of the second projection 5 coming into contact with the first projection 4 adjacent its radiused connection to the inclined surface 12. As indicated previously, the limb 24 is inclined with respect to the axis 8, thus forming a catch with the first projection 4.

During the closing operation produced by relative axial sliding of the plug 3 with respect to the neck 1, the second projection 5 comes into contact, firstly, with the third projection 7 and then with the inclined surface 12 associated with the first projection 4. Because of the axial engagement force exerted and the inclination of the limb 24, and the radial elasticity of the plug 3 at the second projection 5, the second projection 5 is moved radially away from the axis 8 until it reaches the closed position, described hereinbefore, in which it returns to its normal position of engagement with the first projection 4.

In order to promote the radial movement of the second projection 5, the outer skirt 26 preferentially has one or more axial slots 27.

The ramp 6 is disposed on the plug 3 adjacent its transverse apex 28 and at a distance from the remote free edge 20 of the plug 3.

According to one important characteristic of the invention, the ramp 6 is formed by the profiled free edge of an inner skirt 29 of the plug 3.

The outer skirt 26 is radially and outwardly spaced from the inner skirt 29 so as to allow simultaneous co-operation of the first and second projections 4, 7 and co-operation of the ramp 6 and third projection 7.

As will be apparent from the above-described construction, the second projection 5 and the ramp 6 are independent of one another since they are borne by separate skirts 26, 29 respectively. This arrangement is particularly advantageous since by this means the rigidity, particularly the axial rigidity, of the system, which is desirable insofar as concerns the inner skirt 29, since the ramp 6 must take appreciable forces during the opening stage, these forces particularly being greater than those of the outer skirt 26, can be combined with the elasticity, particularly the radial elasticity, of the outer skirt 26.

In elevation the ramp 6 has a general inverted-V shape with an apex 30 closest to the apex 28—two surfaces 31 and two ends 32 of the surfaces 31—furthest away from the apex 28—.

The inside diameter of the inner skirt 29 is slightly larger than the outside diameter of the neck 1 at the outer side surface 10 adjacent the free edge 11 and smaller than the outside diameter at the third projection 7. The axial length of the inner skirt 29 is such that in the closed position the apex 30 can be situated flush with and near the ridge 17 of the third projection 7; the surfaces 31 being slidable—during relative rotation of the plug 3 with respect to the neck 1—on the apex 14 of said projection 7; and finally the ends 32 are preferably spaced, slightly if required, from the inclined surface 12 in order not to interfere therewith. This construction is shown in FIG. 3 to which reference is explicitly made.

The two skirts 26, 29 are secured to the crown 28, which may have a normally downwardly extending return 33, to allow the plug 3 to be gripped, and to surround the skirts 26, 29 on the outside. The crown 28 and the return 33 can be made of a hard and rigid plastics of high quality aesthetically. The crown 28 and the return 33 can be rigid, since the elasticity required is localized at the site of the second projection 5 and of the outer skirt 26.

In a possible variant embodiment, the device also has a masking ring 34 extending axially to surround the outer skirt 26 with a radial clearance at least at and near the second projection 5.

This ring 34 may have a jacket 35 and a disc 36 connecting the jacket 35 to the return 33, more particularly at its free edge. A ring 34 of this kind gives external visual axial continuity of the crown 28 and of the return 33 and masks the outer skirt 26 and any slots 27. The inner surface 37 of disc 36 bears on the outer skirt 26 in its central part, more particularly near the end of the slots 27. This construction enables the free axial length of the outer skirt 26 to be limited to the section contained between the inner edge 37 and the free edge 20, and this, combined with the presence of the slot 27, enables the closing snap-engagement to be given some degree of force.

Preferably the free edge 38 of the jacket 35 is situated axially adjacent the free edge 20, the two edges 20, 38 thus being co-planar. Because of the axial length of the neck 1, the ramp 6 is situated more towards the end of the plug 3 and is therefore relatively invisible. In particular, the ramp 6 is disposed axially between the plane of the disc 36 and the crown 28.

In a preferred embodiment, the device comprises at least three, and more particularly four, second and third projections 5, 7 and an equal number of V-sections for the ramp 6. These projections and sections are distributed uniformly around the axis 8 and are of limited radial size (insofar as concerns the projections).

In one possible variant, the plug 3 has adjacent the transverse crown 28 a sealing means 39 co-operating with the neck 1, e.g. a gasket or a central sleeve.

According to another possible variant, the plug 3 has a means 39 for guiding the plug 3 with respect to the neck 1, more particularly such as a central sleeve.

As will be apparent from the foregoing, the means 39 may be in the form of a central sleeve adjacent the crown 26 and adapted to penetrate into and co-operate with the opening of the neck 1. For example, in the closed position, said sleeve can axially penetrate to half or more of the axial length of the neck 1. To facilitate introduction of the sleeve into the opening of the neck 1, the outer surface of the sleeve adjacent its free edge 40 is preferably chamfered with a bevel 41. The free edge 40 is situated, for example, level with (i.e. in the same plane as) the second projection 5.

I claim:

1. In combination, a container having a neck and a closure for the neck of the container, which closure may be joined to the container by axial insertion and removed from the container by unscrewing thereof:

(a) said neck having a circumferential projection on the outer surface thereof;

(b) said closure comprising inner and outer skirts, said inner skirt being radially inwardly spaced from said outer skirt;

(c) said outer skirt being resilient, and having a projection on the inner surface thereof;

(d) said inner skirt having a free edge provided at least in part by surfaces which are inclined relative to a plane transversely of the axis of said skirts; and (e) projection means on the outer surface of said neck of said bottle for engaging a said inclined surface of said inner skirt upon rotation of said closure for causing axial separating movement of said closure upon rotation thereof and engagement of a said inclined surface of said inner skirt with said projection means.

2. The combination of claim 1, wherein said projection means is of a generally inverted U shape with a radiused end forming an apex and having a base substantially adjacent said circumferential projection, said projection means being of greater thickness at the apex than the base.

3. The combination of claim 2, wherein the projection means is axially between said circumferential projection and the free edge of the neck.

4. The combination of claim 3, wherein the apex of the projection means is defined by a ridge substantially at right angles to the axis of the neck.

5. The combination of claim 1, wherein said projection on said skirt (a) has a generally triangular shape with a radiused tip extending towards the free edge of the outer skirt, and (b) is of lesser thickness at said tip and of greater thickness intermediate said tip and the part thereof remote from said tip.

6. The combination of claim 1, wherein said closure comprises a crown, and wherein said inclined surfaces are closer to said crown than to the free edge of the outer skirt.

7. The combination of claim 1, wherein said outer skirt has at least one axial slot therein whereby to facilitate radial outward movement of the projection therein upon engagement with said circumferential projection.

8. The combination of claim 1, said closure further comprising an axially extending masking ring surrounding the outer skirt and having the inner diameter thereof larger than the outer diameter of said outer skirt at least outwardly of said projection on said outer skirt to thereby provide between said masking ring and said outer skirt a radial clearance to permit radial outward movement of said projection on said outer skirt upon engagement with said circumferential projection.

9. The combination of claim 1, said neck and closure device having a circular contour in cross-section.

10. The combination of claim 1, said closure further comprising sealing means for engaging the neck of the container.

11. The combination of claim 10, said sealing means comprising a sleeve for entering into said neck.

12. The combination of claim 1, wherein said outer skirt and said neck each has four said projections distributed uniformly about the axis of the closure and neck, said projections being of limited circumferential extent.

* * * * *